US007205870B2

(12) United States Patent
Sanada et al.

(10) Patent No.: US 7,205,870 B2
(45) Date of Patent: Apr. 17, 2007

(54) ELECTROMAGNETIC RELAY

(75) Inventors: Hironori Sanada, Tamana (JP); Hiroyasu Tanaka, Yamaga (JP); Hiroaki Yamazaki, Kumamoto (JP)

(73) Assignee: Omron Corporation, Kyoto (JP)

( * ) Notice: Subject to any disclaimer, the term of this patent is extended or adjusted under 35 U.S.C. 154(b) by 137 days.

(21) Appl. No.: 10/706,854

(22) Filed: Nov. 12, 2003

(65) Prior Publication Data

US 2004/0113729 A1 Jun. 17, 2004

(30) Foreign Application Priority Data

Nov. 12, 2002 (JP) ..... 2002-328087

(51) Int. Cl.
*H01H 51/22* (2006.01)

(52) U.S. Cl. ..... 335/78; 335/83; 335/128

(58) Field of Classification Search ..... 335/78–86, 335/128–130

See application file for complete search history.

(56) References Cited

U.S. PATENT DOCUMENTS 5,289,144 A * 2/1994 Liao ..... 335/78
5,719,541 A * 2/1998 Mader ..... 335/78
6,606,018 B2 * 8/2003 Takano et al. ..... 335/78

FOREIGN PATENT DOCUMENTS

| | | |
|---|---|---|
| EP | 1 009 008 | 6/2000 |
| EP | 1 246 214 | 10/2002 |
| JP | 4-119947 | 10/1992 |

OTHER PUBLICATIONS

Patent Abstracts of Japan, Publication No. 2002-289079, Publication Date Oct. 4, 2002, 26 pages.

* cited by examiner

*Primary Examiner*—Elvin Enad
*Assistant Examiner*—Bernard Rojas
(74) *Attorney, Agent, or Firm*—Osha Liang LLP

(57) ABSTRACT

An electromagnetic relay having a moving contact plate and fixed contact plates juxtaposed with one another on a base. A moving iron plate is rotated during magnetization/demagnetization of a coil block put on the base to reciprocate a card in a horizontal direction. The moving contact plate is allowed to undergo elastic deformation so that a contact on the moving contact plate is brought into contact and out of contact with contacts on the fixed contact plates. The top corners of the moving contact plate is bent into an upper component and a lower components in such a fashion as to form card acceptance portions, and a distal end portion of the card is brought into contact with an inner surface of the card acceptance portions.

6 Claims, 12 Drawing Sheets

ELECTROMAGNETIC RELAY

BACKGROUND OF THE INVENTION

1. Field of the Invention

This invention relates to an electromagnetic relay.

2. Description of the Related Art

A known electromagnetic relay employs a construction in which a moving contact plate is allowed to undergo elastic deformation through a card to thereby open and close contacts (refer to patent reference 1, for example).

Patent reference 1:

Microfilm of Japanese Utility Model Application No.23090/1991 (JP-UM-A-4-119947)

In the electromagnetic relay of the prior art described above, however, first and second protuberances are formed on the card, the first protuberance is inserted through a through-hole formed in the moving contact plate to guide the card and the second protuberance can be pushed and brought into contact with the moving contact plate. The card is formed of a resin and the moving contact plate is formed of a metal. Therefore, the protuberances of the card come into sliding contact with the moving contact plate and generate wear dust, or the like. The wear dust adhering to contacts is likely to deteriorate contact reliability of the contacts. An inserting work of the first protuberance of the card through the through-hole of the moving contact plate is troublesome at the time of assembling.

It is therefore an object of the invention to provide an electromagnetic relay that can acquire a satisfactory operation without generating the wear dust though it has a simple construction.

SUMMARY OF THE INVENTION

To accomplish this object, the invention provides an electromagnetic relay in which a moving contact plate and fixed contact plates are juxtaposed with one another on a base, a moving iron plate is rotated on the basis of magnetization/demagnetization of a coil block put on the base to reciprocate a card in a horizontal direction, and the moving contact plate is allowed to undergo elastic deformation so that a moving contact provided to the moving contact plate is brought into contact with and out of contact from fixed contacts provided to the fixed contact plates, wherein a distal end portion of the moving contact plate is bent in such a fashion as to form card acceptance portions positioned at least at upper and lower positions, and a distal end portion of the card is brought into contact with an inner surface of the card acceptance portions.

This construction can bring the distal end portion of the card and the card acceptance portions of the moving contact plate at least into line contact, and can restrict the occurrence of the wear dust by diffusing a sliding contact range. Because it is only necessary to guide the distal end portion of the card by the card acceptance portions, an assembly work can be carried out extremely simply.

The card described above is preferably equipped with a guide portion for guiding from both sides the card acceptance portions formed on the moving contact plate because a contact switch operation can be conducted under a stable state.

Preferably, the card has a reduced thickness portion that is guided by the card acceptance portions. For, when ribs for reinforcing the reduced thickness portion guide the card acceptance portions, desired rigidity can be secured while reducing the weight of the card and the contact switch operation can be stabilized.

Preferably, the fixed contact plate is interposed between the moving contact plate and the coil block so that a bent portion at a distal end thereof is positioned above a push-in portion of the moving contact plate, and the card acceptance portion of the moving contact plate has an escape portion for allowing insertion of the fixed contact plate because each contact plate can be appropriately pushed in irrespective of the restrictive condition of the push-in position.

DESCRIPTION OF THE PREFERRED EMBODIMENTS

Embodiments of the invention will be hereinafter explained with reference to the accompanying drawings.

Figure 1:
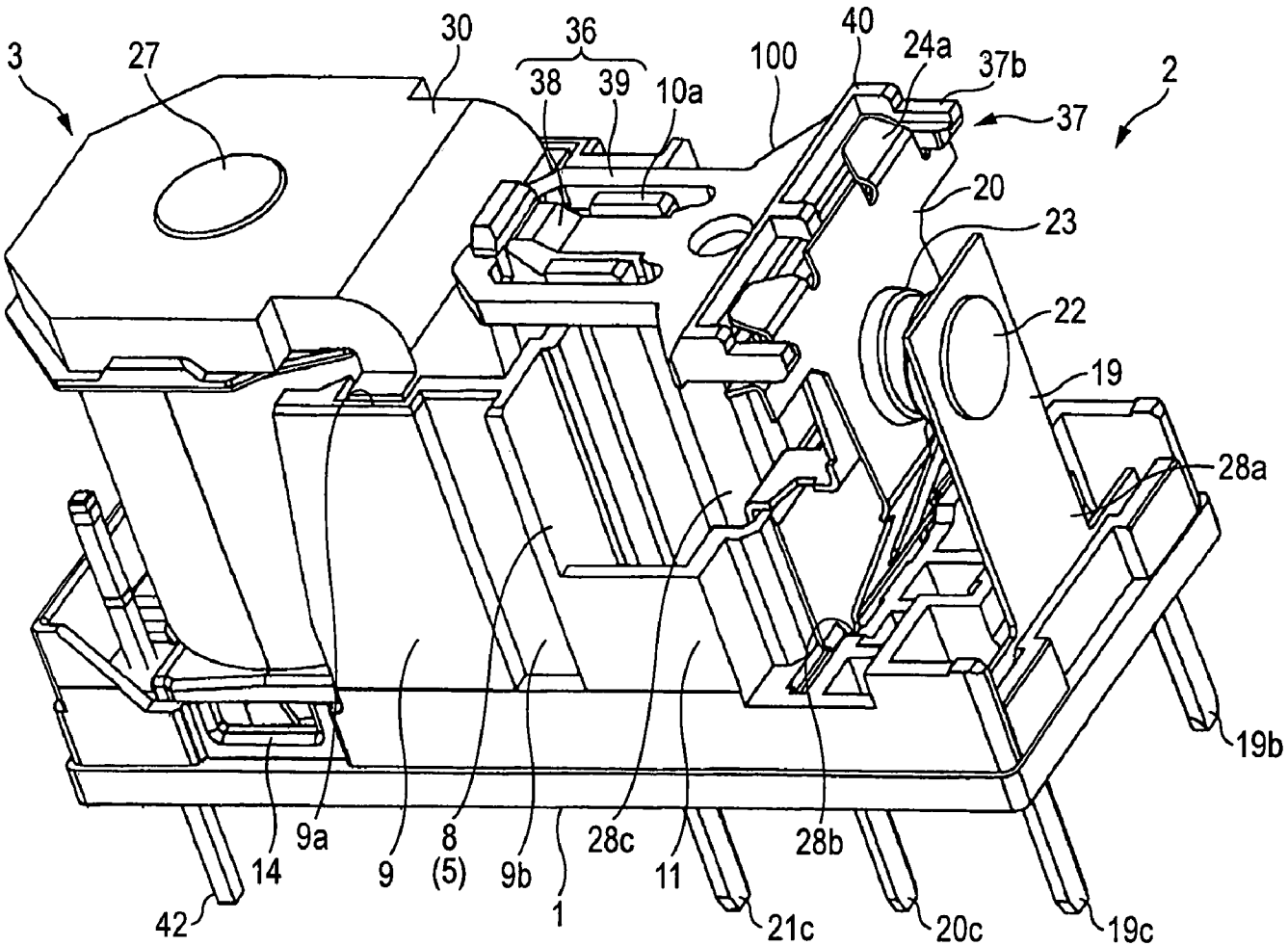
FIG. 1 is a perspective view of an electromagnetic relay according to an embodiment of the invention when its case is removed.
Figure 2:
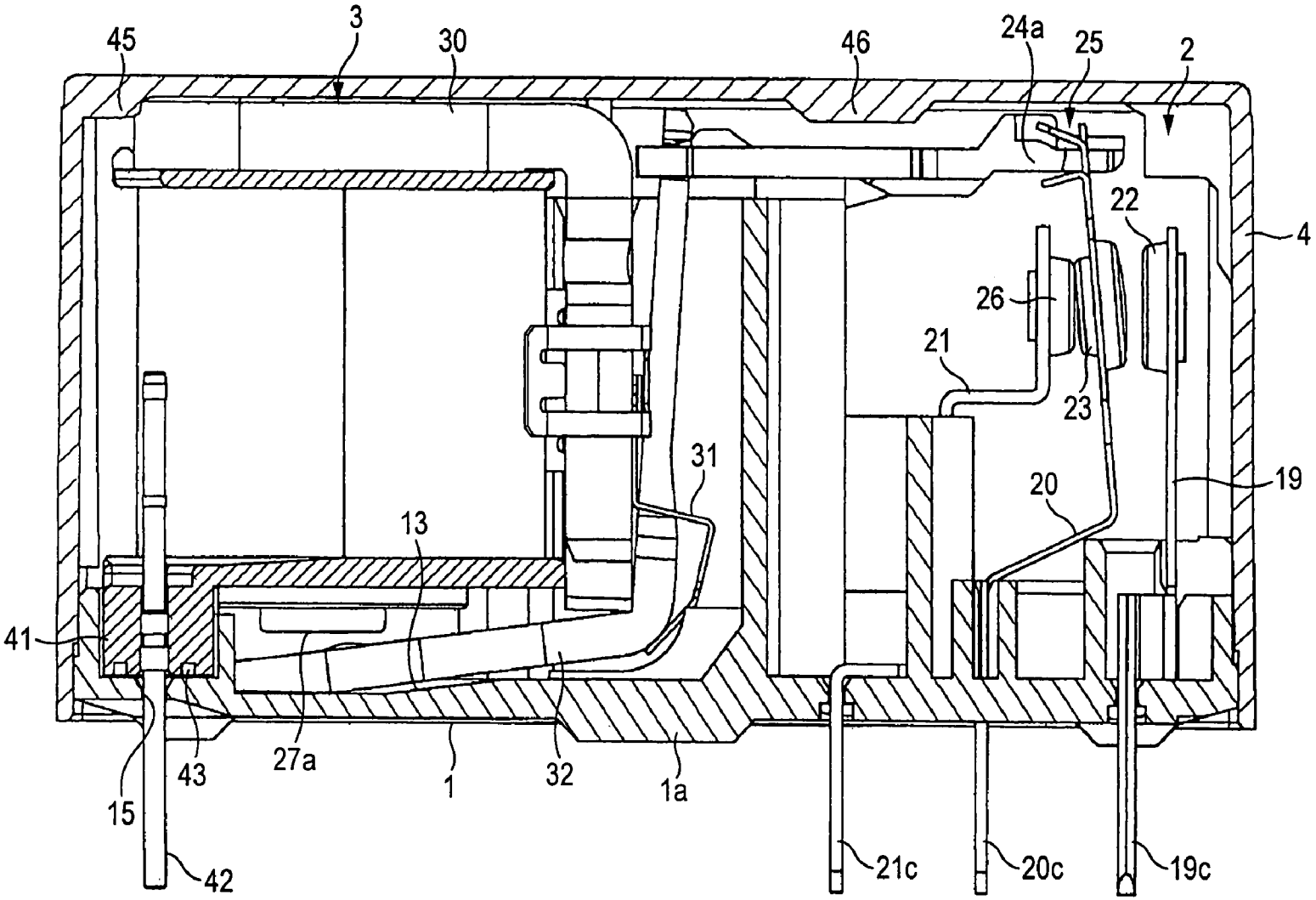
FIG. 2 is a sectional view of the electromagnetic relay according to the embodiment of the invention.

FIGS. 1 and 2 show an electromagnetic relay according to an embodiment. The electromagnetic relay briefly has a construction in which a contact switch mechanism 2 and a coil block 3 are arranged on a base 1 and these constituents are covered with a case 4.

Figure 8:
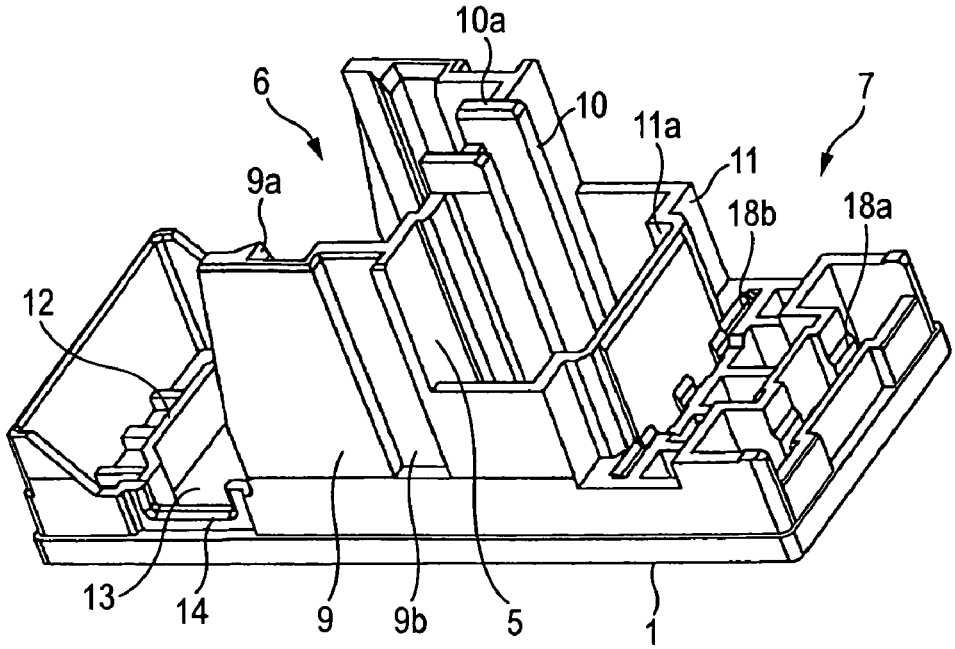
FIG. 8 is a perspective view of a base.
Figure 9:
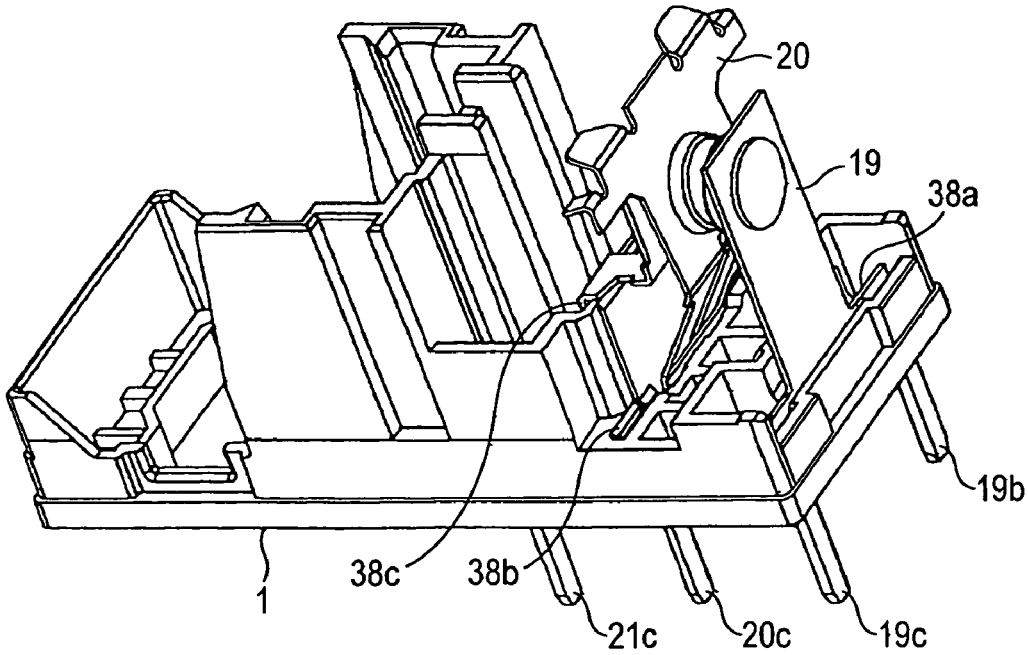
FIG. 9 is a perspective view showing the state where each contact plate is assembled to the base.
Figure 10:
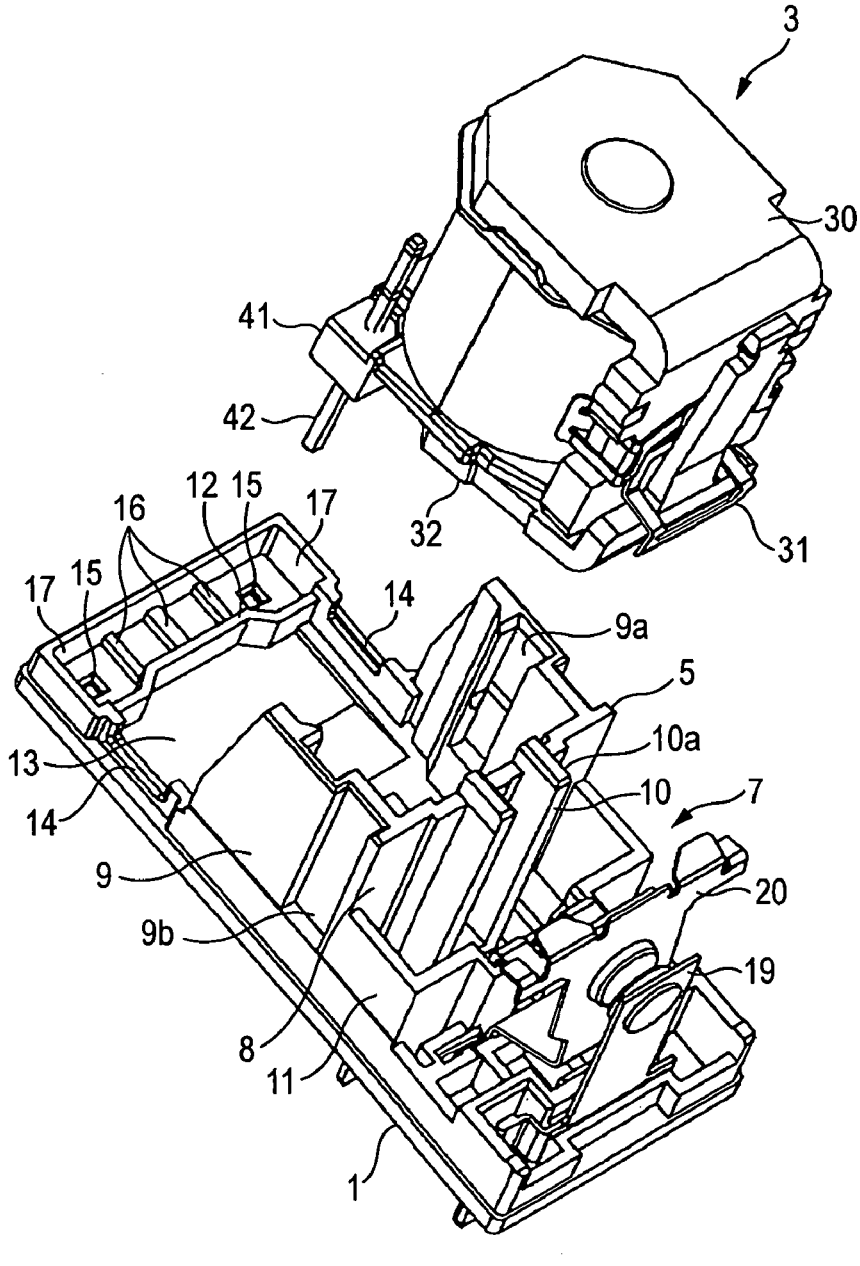
FIG. 10 is a perspective view showing the state before the coil block is assembled to the base to which each contact plate is assembled.

An insulating wall 5 divides the base 1 into a coil block-fitting portion 6 and a contact switch mechanism-fitting portion 7 as shown in FIGS. 8 to 10.

The insulating wall 5 has a partition portion 8 and both side portions 9. Protuberance portions 10 are so formed at the center of the partition portion 8 as to extend in a vertical direction with a predetermined gap between them. The protuberance portions 10 reinforce the partition portion 8 and guide with their upper edge protuberance portions 10*a* a card 100 that will be later described. An auxiliary insulating wall 11 is formed at a lower part of each protuberance portion 10 in such a fashion as to define a recess in cooperation with the insulating wall 5. A guide groove 11*a* extending in the vertical direction is formed at the center of the inner surface of the auxiliary insulating wall 11. On the other hand, groove portions 9*a* and 9*b* extending in the vertical direction while their positions are deviated from each other are formed on the inner and outer surfaces of both side portions 9, respectively. The inner surface groove portion 9*a* guides a yoke 30 to be later described. The outer surface groove portion 9*b* is a recession for molding the base 1.

As particularly shown in FIG. 10, a partition wall 12 partitions the coil block-fitting portion 6. An escape recess portion 13 is defined in the bottom surface on the side of the insulating wall so partitioned. A notch portion 14 is defined in both sidewalls. Through-holes 15 are defined in the remaining partitioned portions and coil terminals 42 are fitted into both end portions of the through-hole 15. Three base reinforcement ribs 16 defined between both through-holes 15 connect the partition wall 12 to the sidewall on one of the sides. The base reinforcement ribs 16 allow a resin to smoothly fluidize when the base 1 is molded even when the thickness of the bottom surface is small and also play the role of reinforcement. The partition wall 12 and the base reinforcement ribs 16 together constitute a push-in acceptance portion 17 for pushing and fixing an increased thickness portion 41 of the coil block 3 that will be later described.

Incidentally, reference numeral la denotes a standoff. The standoff la forms a clearance with the bottom surface of the base when the electromagnetic relay is mounted to a printed board and eliminates influences of a solder at the time of soldering.

The contact switch mechanism-fitting portion 7 has contact plate push-in portions 18*a*, 18*b* and 18*c* at three positions as shown in FIG. 8.

The contact switch mechanism 2 includes a first fixed contact plate 19, a moving contact plate 20 and a second fixed contact plate 21 that are serially pushed into the contact plate push-in portions 18*a*, 18*b* and 18*c* from one of the ends 18*a* of these contact plate push-in portions 18*a*, 18*b* and 18*c*.

Figure 3C:
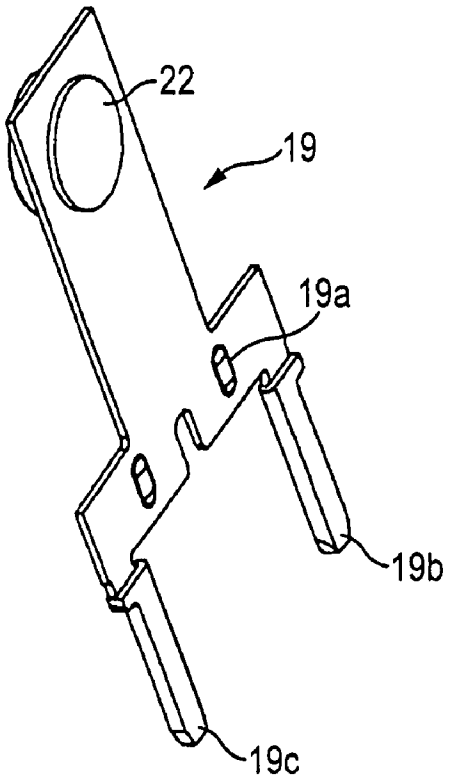
FIG. 3C is a perspective view of a second fixed contact plate.

The first fixed contact plate 19 is substantially flat as shown in FIG. 3C and has at its upper end the first fixed contact 22 and at its lower end a protuberance 19*a* to be pushed into the contact plate push-in portion 18. Terminal portions 19*b* and 19*c* extend downward from both sides of the first fixed contact plate 19.

Figure 3B:
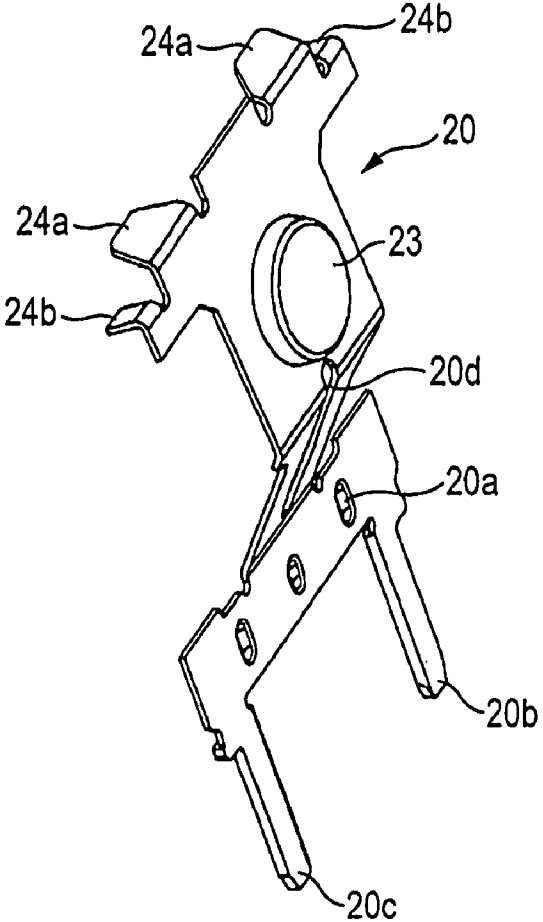
FIG. 3B is a perspective view of a moving contact plate.
Figure 3A:
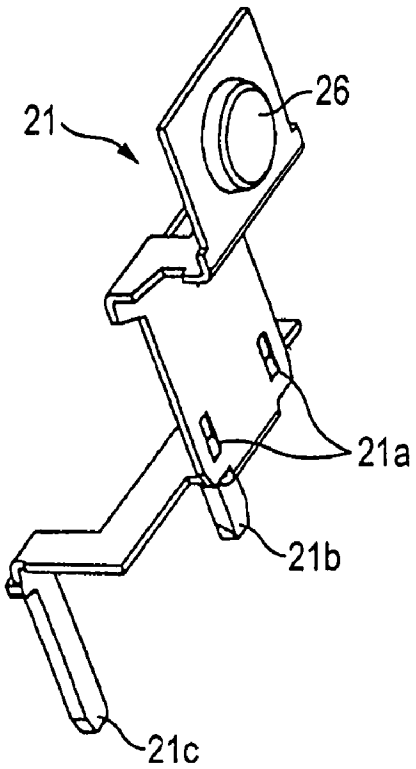
FIG. 3A is a perspective view of a first fixed contact plate.

The moving contact plate 20 has on both surfaces of its upper end a moving contact 23 having a contact surface with respect to the fixed contacts 22 and 26 as shown in FIG. 3B. Card acceptance portions 24*a* and 24*b* extending obliquely vertically are formed at the upper edge of the moving contact plate 20. A protruding distance of the card acceptance portions 24*a* and 24*b* is set to a value at which the card 100 to be later described does not fall off even when the moving contact plate 20 undergoes elastic deformation. The intermediate part of each card acceptance portion 24*a*, 24*b* constitutes an escape portion 25 lest it becomes an obstacle when the second fixed contact plate 21 is inserted from above. Push-in protuberance portions 20*a* are formed at the lower end of the moving contact plate 20 in the same way as the first fixed contact plate 19. Terminal portions 20*b* and 20*c* extend from both sides of the moving contact plate 20. The center portion is bent into a crank shape and a slit 20*d* is formed at the center so that the moving contact plate 20 can easily undergo elastic deformation.

The second fixed contact 26 is fixed to the upper end of the second fixed contact plate 21. The second fixed contact plate 21 is bent into a crank shape from its part in the proximity of the second fixed contact 26. Push-in protuberance portions 21a are formed at the lower end of the second fixed contact plate 21 in the same way as both contact plates 19 and 20. The lower portion of the second fixed contact plate 21 below the push-in protuberance portions 21*a* is bent substantially at right angles in the horizontal direction and terminal portions 21*b* and 21*c* extend downward from both ends of the bent portion. The second fixed contact plate 21 is fitted to the base 1 under the state where it is guided by the guide groove 11*a* of the auxiliary insulating wall 11. The auxiliary insulating wall 11 secures desired insulating performance (creep distance) with the moving contact plate 20 when the moving contact 23 is spaced apart from the second fixed contact 26.

Figure 4:
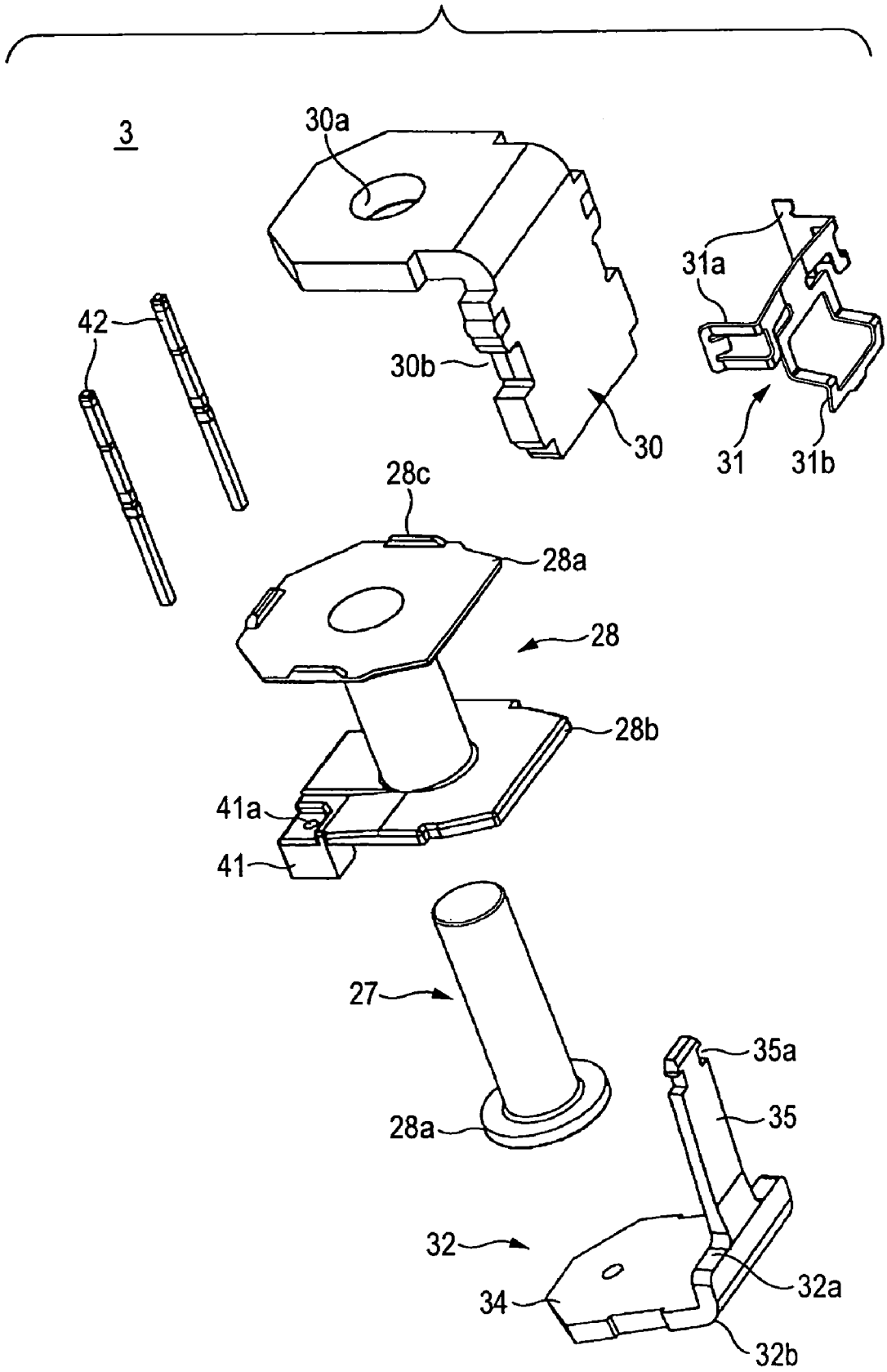
FIG. 4 is an exploded perspective view of a coil block.
Figure 5:
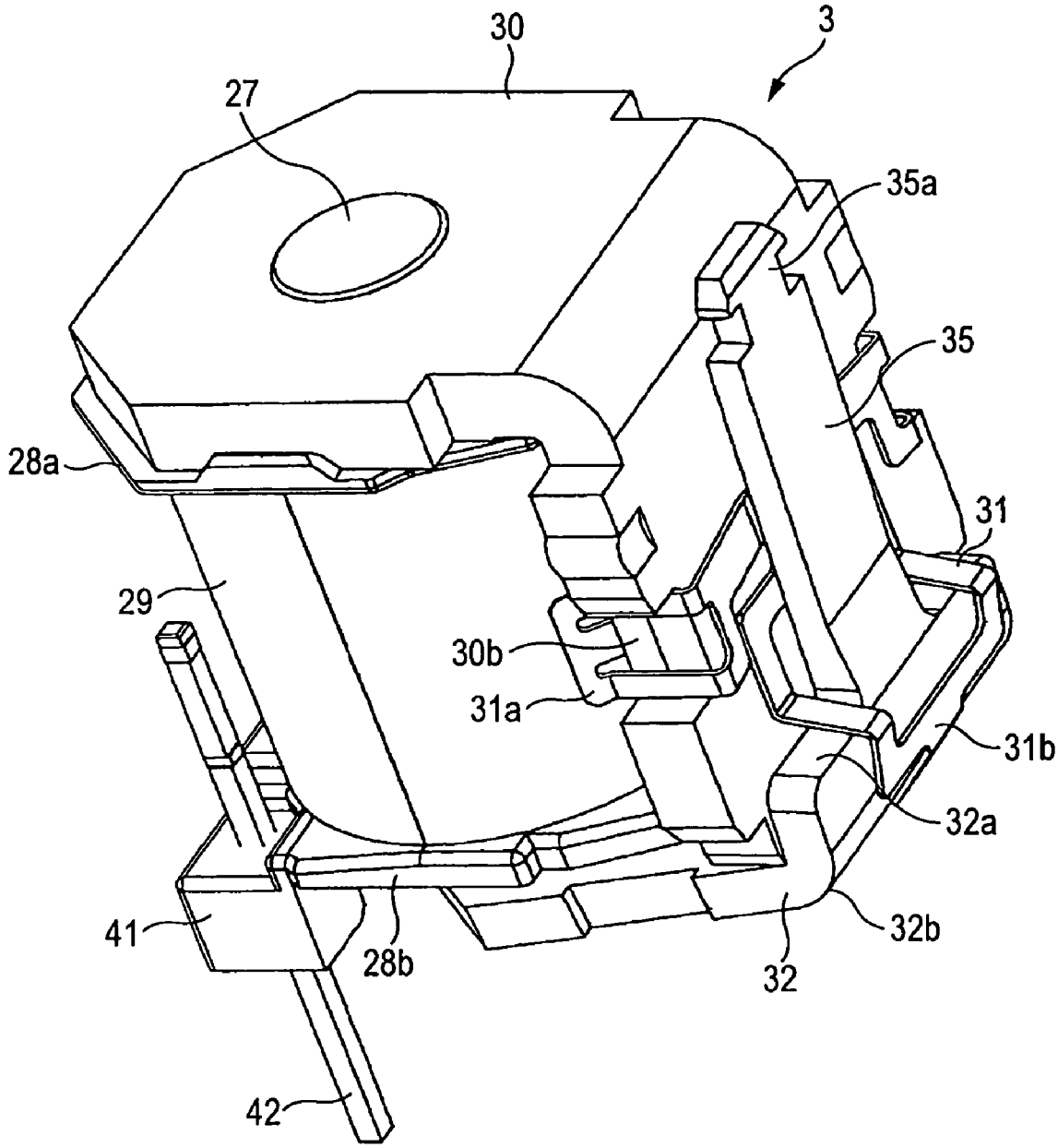
FIG. 5 is a perspective view of the coil block.

The coil block 3 is obtained by winding a coil 29 onto a core 27 through a spool 28 as shown in FIGS. 4 and 5.

A yoke 30 is fixed to the upper end of the core 27. A flange-like lower end of the core 27 operates as an attraction surface 27*a*. The yoke 30 is constituted by a substantially L-shaped magnetic material and has at the center of one of its ends an opening 30*a* into which the core 27 is fitted and fixed. An anchor acceptance portion 30*b* for fitting a hinge spring 31 is formed at a side edge of the other end of the yoke 30. The other end of the yoke 30 operates as a support point for rotation. A substantially L-shaped moving iron plate 32 is supported in such a fashion that a bent portion 33 can freely rock while being held by the hinge spring 31. One of the ends of the moving iron plate 32 is an attracted portion 34 that is attracted to the attraction surface 27*a* of the core 27, and an anchor portion 35*a* is formed at the upper end of a reduced width portion 35 at the other end of the moving iron plate 32. The hinge spring 31 includes an anchor portion 31*a* anchored to the anchor acceptance portion 30*b* of the yoke 30 described above and a rectangular pressure contact portion 31*b* into which the reduced width portion 35 of the moving iron plate 32 is fitted and which comes into pressure contact with the bent portion 33. The rectangular pressure contact portion 31*b* comes into pressure contact with a step portion 32*a* and a curved surface 32*b* of the bent portion 33 of the moving iron plate 32 and urges the moving iron plate 32 counter-clockwise in FIG. 2, that is, in a direction in which the attracted portion 34*b* comes away from the attraction surface 27*a* of the core 27.

Figure 7:
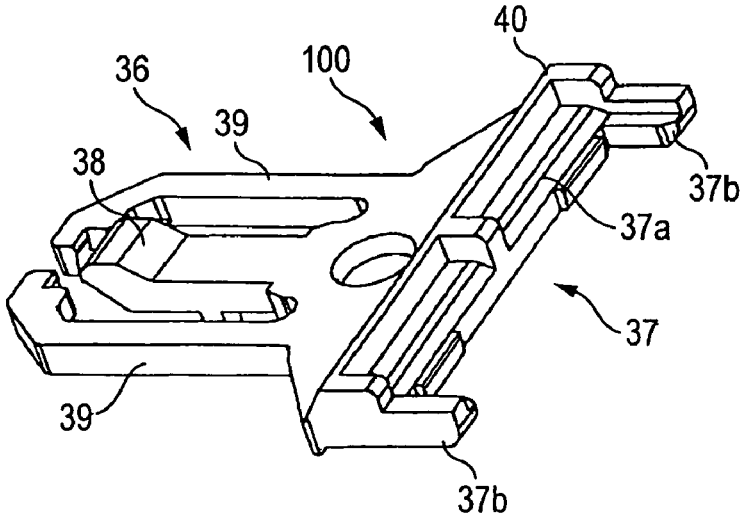
FIG. 7 is a perspective view of a card.

The card 100 is interposed between the anchor portion 35*a* of the moving iron plate 32 and the card acceptance portion 24 of the moving contact plate 20. As shown in FIG. 7, the card 100 has at one of its ends an anchor holding portion 36 to which the anchor portion 35*a* of the moving iron plate 32 is anchored and at its other end a push portion 37 into which the card acceptance portion 24 is pushed. The anchor holding portion 36 has a contact plate 38 that comes into contact with the anchor portion 35*a* of the moving iron plate 32, and a flexible holding plate 39 that flexibly holds the anchor portion 35*a* from both sides. A clearance is defined between the contact plate 38 and the flexible holding plate 39. When the upper end protuberance portion 10*a* formed on the insulating wall 5 of the base 1 is positioned, the card 100 is guided during its horizontal movement. The push-in portion 37 has a reduced thickness portion 37*a* and guide plates 37*b* and 37*b*. The guide plates 37*b* and 37*b* are positioned on both sides of the reduced thickness portion 37*a* and are supported by the card acceptance portions 24*b* on the lower side. The distal end of the reduced thickness portion 37*a* is preferably shaped into a taper surface or a curve surface so that the reduced thickness portion 37*a* can come into surface contact with the card acceptance portions 24*a* and 24*b* of the moving contact plate 20. A card reinforcement rib 40 having a substantial E shape when viewed on a plane reinforces the reduced thickness portion 37*a*. Upper and lower card acceptance portions 24*a* and 24*b* of the moving contact plate 20 come into contact with the upper and lower surface edge portions of the reduced thickness portion 37*a*, respectively. The card reinforcement rib 40 not only reinforces the reduced thickness portion 37*a* but also allows a resin to smoothly flow when the card 100 is molded and prevents the occurrence of problems such as short shot. The guide plates 37*b* and 37*b* guide from both sides the card acceptance portion 24*a* on the upper side.

Figure 6:
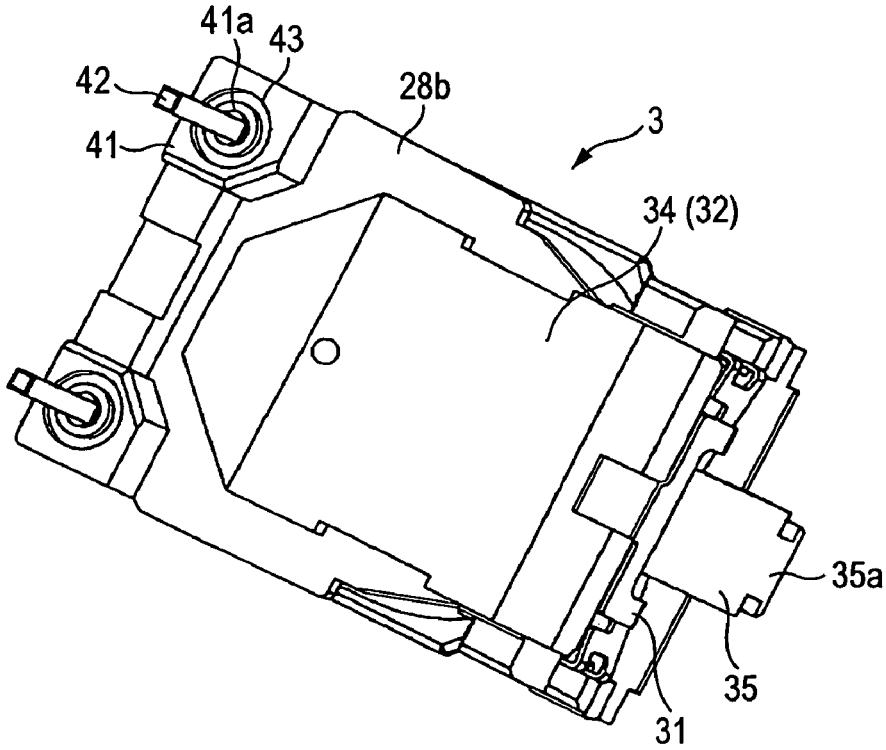
FIG. 6 is a perspective view of the coil block when it is viewed from a bottom side.

As shown in FIGS. 4 and 6, the spool 28 has a cylindrical shape and the core 27 is inserted through the spool 28. The spool 28 has flanges 28*a* and 28*b* at its both ends. Protuberances 28*c* are formed at three positions of the upper flange 28*a* and guide the yoke 30. Increased thickness portions 41 are formed on both sides of the lower flange 28*b*. Each increased thickness portion 41 has a terminal hole 41*a* into which the coil terminal 42 is pushed. A ring-like recess 43 is formed around the terminal hole 41*a* on the bottom surface side. Each increased thickness portion 41 is pushed into each push-in acceptance portion 17 of the base 1 when the coil block 3 is fitted to the base 1, stores a sealant flowing from the through-hole 15 in its ring-like recess 43 and prevents further inflow.

The coil 29 is wound on a drum portion of the spool 28 and both of its ends are wound on the coil terminal 42, respectively.

Figure 13:
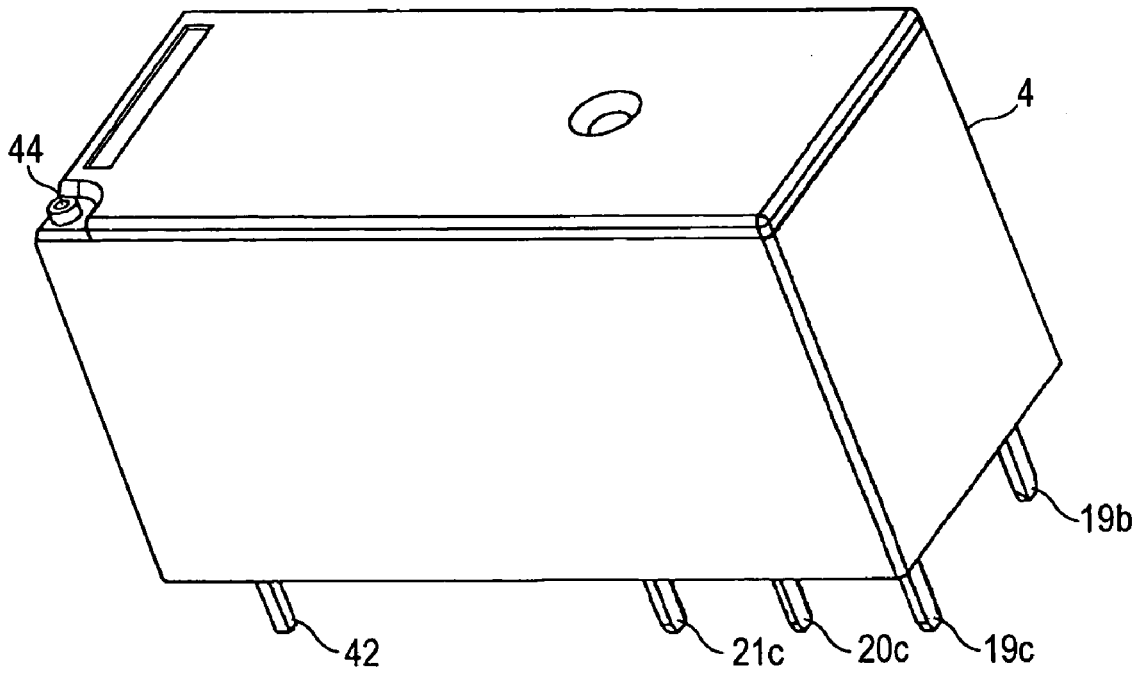
FIG. 13 is a perspective view of an electromagnetic relay.

Referring to FIG. 13, the case 4 has substantially a box shape the lower surface of which is open. When the open edge of the lower surface of the case 4 is fitted to the side surfaces of the base 1, the case 4 covers constituent components. A gas vent hole 44 is formed at a corner of the upper surface to emit the gas resulting from the seal work to the outside. The gas vent hole 44 is thermally sealed when the electromagnetic relay is completed. First and second protuberance portions 45 and 46 protruding inward are formed at a corner and substantially at a center portion of the ceiling surface of the base 1 as shown in FIG. 2, respectively. The first protuberance portion 45 guides the yoke 30 and the second protuberance portion 46 restricts the moving range of the card 100.

An assembling method of the electromagnetic relay described above will be subsequently explained.

The coil block 3 is formed in a separate step. In other words, the coil 29 is wound on the core 27 through the spool 28 as shown in FIG. 4 and both ends of the coil 29 are wound on the coil terminals 42 pushed into and fixed to the increased thickness portion 41, respectively. One of the ends of the yoke 30 is fixed to the upper end of the core 27 and the moving iron plate 32 is arranged at the other end of the yoke 30 in such a fashion as to be capable of rocking. The moving iron plate 32 is fitted to the yoke 30 through the hinge spring 31 and is urged to come away from the attraction surface 27*a* of the core 27. The coil block 3 shown in FIG. 5 is thus completed.

Figure 11:
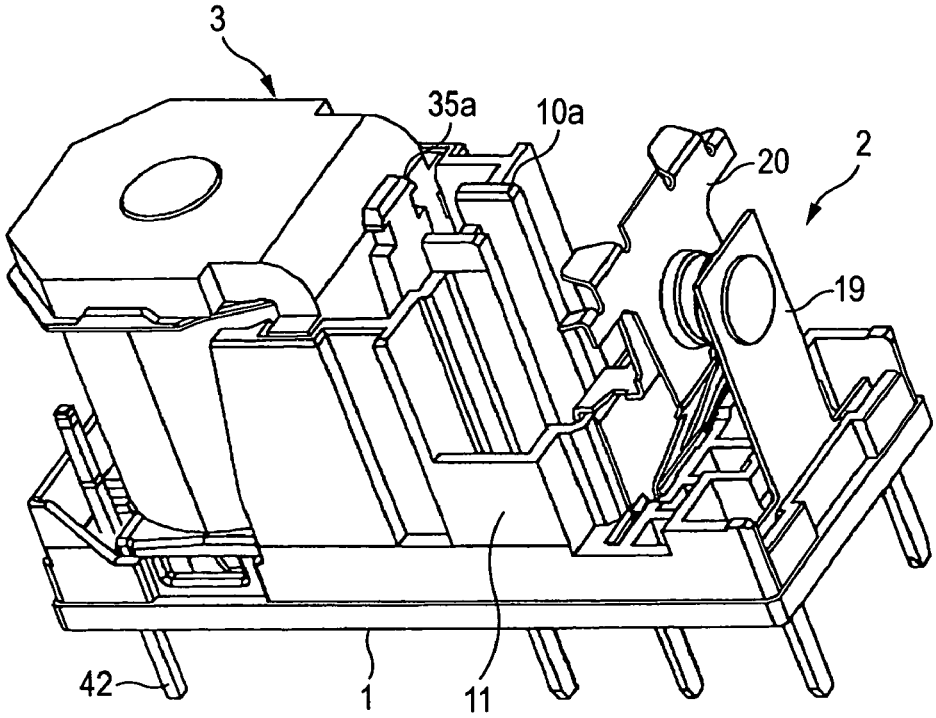
FIG. 11 is a perspective view showing the state where each contact plate and the coil block are assembled to the base.

The moving contact plate 20 and the first and second fixed contact plates 19 and 21 are pushed into and fixed to the base 1 as shown in FIG. 9 and the completed coil block 3 is assembled to the base 1 as shown in FIGS. 10 and 11. The coil block 3 is fixed as the increased thickness portion 41 is pushed into the push-in acceptance portion 17 and both side portions 9 of the yoke 30 are pushed into the inner surface groove portion 9*a*. A space is defined under this state between the base 1 and the coil block 3 and a rotation space of the moving iron plate 32 can be secured. However, the escape recess 13 formed in the base 1 restricts the height of the electromagnetic relay. Each contact plate is pushed into and fixed to the base 1 in the sequence of the first fixed contact plate 19, the moving contact plate 20 and the second fixed contact plate 21. When the second fixed contact plate 21 is first pushed in, its bent portion prevents the push-in operation of the moving contact plate 20. Therefore, the moving contact plate 20 is first pushed in and then the second fixed contact plate 21 is pushed in and fixed. In this case, the escape portion 25 prevents the interference of the second fixed contact 26 though the card acceptance portion 24 is formed at the upper end of the moving contact plate 20.

Figure 12:
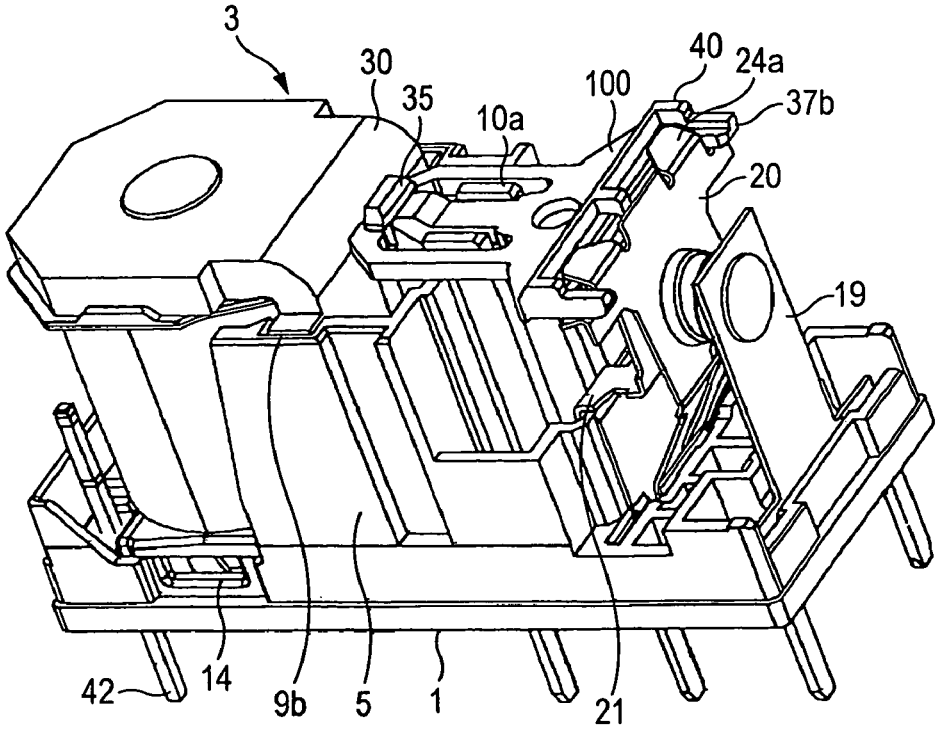
FIG. 12 is a perspective view showing the state where each contact plate and the coil block are assembled to the base and the card is fitted.
Figure 14:
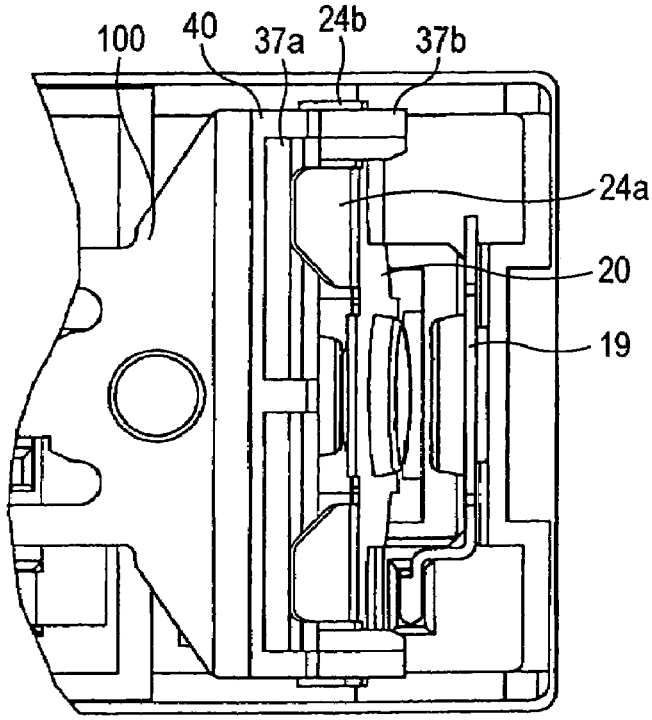
FIG. 14 is a partial plan view showing a contact switch mechanism.
Figure 15:
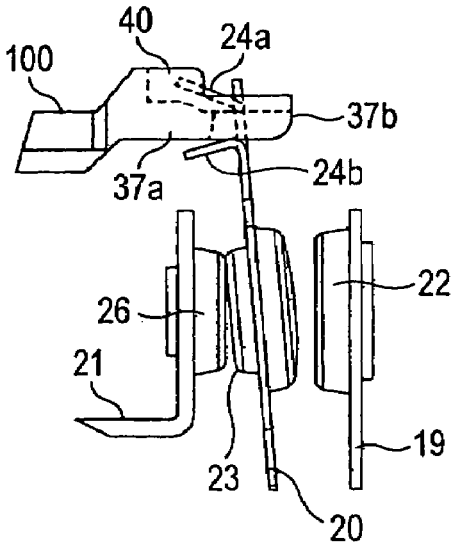
FIG. 15 is a partial front view showing the contact switch mechanism.

After the push-in and fixing operation of the coil block 3 and each contact plate 19, 20, 21 to the base 1 is completed, the anchor holding portion 36 of the card 100 is anchored to the anchor portion 35*a* of the moving iron plate 32 as shown in FIG. 12. In other words, when the anchor holding portion 36 is pushed from the side of the anchor portion 35*a*, the flexible holding plate 39 undergoes elastic deformation and then returns to its original shape. In consequence, the flexible holding plate 39 and the contact plate 38 hold the anchor portion 35*a*. After the moving contact plate 20 is allowed to undergo elastic deformation and then to return to its original shape, the reduced thickness portion 37*a* of the card 100 is positioned between the upper and lower card acceptance portions 24 formed at the upper end of the moving contact plate 20. As shown in FIGS. 14 and 15, the card acceptance portions 24 prevent fall-off of the card 100 in the vertical direction and the guide plate 37*b* formed on the card 100 prevents a positioning error of the card 100 in the transverse direction.

After fitting of the card 100 is completed, power is applied to the coil 29 through the coil terminals 42 and the coil block 3 is magnetized and demagnetized to thereby rotate the moving iron plate 32. Whether or not the moving iron plate 32 is appropriately attracted to the attraction surface 27*a* of the core 27 is confirmed with eye or by use of laser through the notch portion 14 formed in the base 1. Whether or not switching of the contacts is appropriately conducted is also confirmed at this time to inspect the absence/existence of an operation defect. When any operation defect exists, the shape of the moving contact plate 20 is deformed for adjustment, for example.

When the operation is satisfactory, the case 4 is fitted to the base 1 as shown in FIG. 13 to cover the constituent components. The base 1 is turned upside down so that its bottom surface faces upward, and the terminal holes and the fitting portion between the base 1 and the case 4, and so forth, are sealed with the sealant by use of a nozzle, or the like. The sealant enters the inside due to capillary. The sealant entering from the clearance between each terminal portion 19*b*, 19*c*, 20*b*, 20*c*, 21*b*, 21*c* of each contact plate 19, 20, 21 and the terminal hole is far from the region in which the contacts are opened and closed, and improves the fixing strength of the contact plates to the base 1. The sealant entering from the clearance between the coil terminal 42 and the through-hole 15 is stored in the ring-like recess 43 formed in the increased thickness portion 41 of the coil block 3 and its further invasion is checked. Even when the sealant enters beyond the ring-like recess portion 43, the partition wall 12 prevents the sealant from reaching the driving region of the moving iron plate 32. Therefore, even when the driving region of the moving iron plate 32 is positioned in the proximity of the region that the sealant enters, the problem due to adhesion, etc does not occur.

The electromagnetic relay is completed in the manner described above. However, the gas vent hole 44 formed in the case 4 may well be used while left open or under the sealed state after it is thermally sealed depending on the environment of use. Even when impact force acts on the internal constituent components due to fall, or the like, no problem occurs because each component is firmly fixed to the base 1. The card 100, in particular, has the simple construction in which the moving iron plate 32 and the moving contact plate 20 are merely interconnected. One of the ends of the card is interconnected to the moving iron plate 32 through the anchor holding portion 36 and the other end guides the reduced thickness portion 37*a* of the push-in portion 37 within the range in which the moving contact plate 20 can undergo deformation. The upper end protuberance portion 10*a* formed on the insulating wall 5 of the base 1 is positioned between the contact plate 38 and the flexible holding plate 39 constituting the anchor holding portion 36 and the second protuberance portion 46 formed on the case 4 is positioned above the card 100. Therefore, even when any impact force operates, the card 100 does not fall off.

Next, the operation of the electromagnetic relay described above will be explained.

While power is not applied to the coil 29 and the coil block 3 is demagnetized, the moving iron plate 32 rotates counter-clockwise in FIG. 2 due to the urging force of the hinge spring 31 with the rotation support point at the distal end of the yoke 30 being the center. In consequence, the moving contact plate 20 is under the erected state due to its own flexible force and keeps the moving contact 23 under the closed state relative to the second fixed contact 26.

When power is applied to the coil 29 and the coil block 3 is excited, one of the ends of the moving iron plate 32 is attracted to the attraction surface 27*a* of the core 27 and the moving iron plate 32 rotates clockwise in FIG. 2 with the rotation support point at the distal end of the yoke 30 being the center. In consequence, the card 100 moves to the right and the moving contact plate 20 undergoes elastic deformation. In this case, since the distal end of the reduced thickness portion 37*a* of the card 100 pushes the card acceptance portion 24 of the moving contact plate 20, contact becomes line contact or surface contact and wear dust does not develop. Movement of the card 100 closes the moving contact 23 relative to the first fixed contact 22 and the contact is thus switched.

Figure 16:
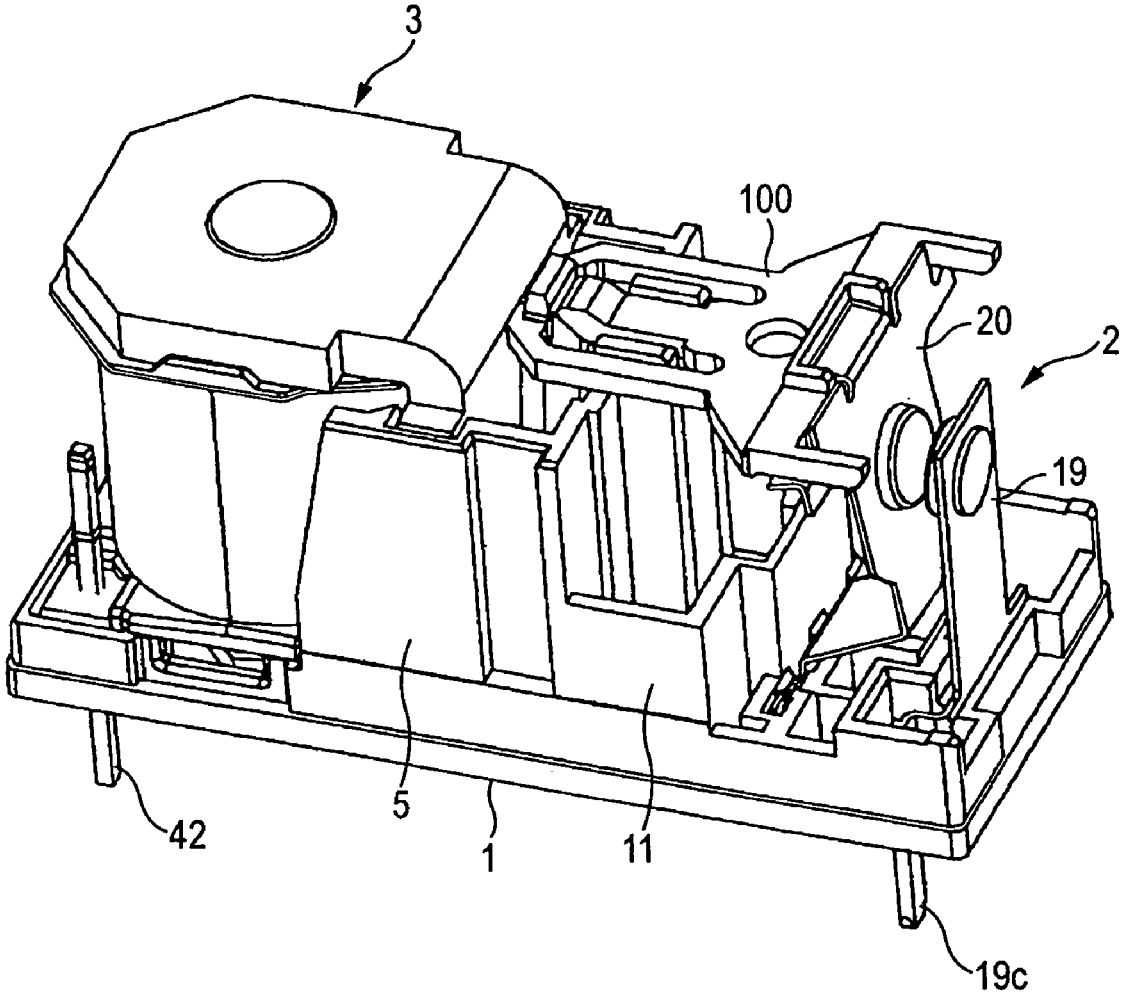
FIG. 16 is a perspective view of an electromagnetic relay according to another embodiment.

In the embodiment described above, the fixed contact plates 19 and 20 are disposed on both sides of the moving contact plate 20, but they may be disposed on only one side. In other words, it is possible to employ a construction in which only the second fixed contact plate 21 is not disposed but the rest of the constituent components is as such used as shown in FIG. 16.

In the embodiment described above, the guide plate 37*b* of the card 100 is disposed separately from the card reinforcement rib 40. However, it is also possible to employ a construction in which the card reinforcement rib 40 operates also as the guide plate 37*b*. In other words, the card reinforcement ribs 40 positioned on both sides guide both sides 9 of the upper card acceptance portion 24. At least one each card acceptance portion 24 of the moving contact plate 20 may well exist at the upper and lower positions. In the construction in which the second fixed contact plate 21 is not disposed, the card acceptance portion 24 may well be formed at the center.

As is obvious from the explanation given above, the invention forms the card acceptance portions positioned at least at the upper and lower positions by bending the upper end portion of the moving contact plate. Therefore, even when the moving contact plate is driven through the card, wear dust does not easily occur, and the assembly work of the card can be easily carried out.

What is claimed is:

1. An electromagnetic relay in which a moving contact plate and fixed contact plates are juxtaposed with one another on a base, a moving iron plate is rotated on the basis of magnetization/demagnetization of a coil block put on said base to reciprocate a card in a horizontal direction, and said moving contact plate is allowed to undergo elastic deformation so that a moving contact provided to said moving contact plate is brought into contact with and out of contact from fixed contacts provided to said fixed contact plates, wherein:

a first portion at a top edge at each corner of said moving contact plate is bent into an upper component, and a second portion at the top edge at each corner of said moving contact plate is bent into a lower component in such a fashion as to form card acceptance portions, and a distal end portion of said card is brought into direct contact with an inner surface of said card acceptance portions.

2. An electromagnetic relay according to claim 1, wherein said card has a guide portion for guiding said card acceptance portions formed on said moving contact plate from both sides.

3. An electromagnetic relay according to claim 2, wherein said card has a reduced thickness portion guided by said card acceptance portions, and ribs reinforcing said reduced thickness portion guide said card acceptance portions.

4. An electromagnetic relay according to claim 1, wherein said fixed contact plate is interposed between said moving contact plate and said coil block so that a bent portion at a distal end thereof is positioned above a push-in position of said moving contact plate, and said card acceptance portion of said moving contact plate has an escape portion for allowing insertion of said fixed contact plate.

5. An electromagnetic relay according to claim 2, wherein said fixed contact plate is interposed between said moving contact plate and said coil block so that a bent portion at a distal end thereof is positioned above a push-in position of said moving contact plate, and said card acceptance portion of said moving contact plate has an escape portion for allowing insertion of said fixed contact plate.

6. An electromagnetic relay according to claim 3, wherein said fixed contact plate is interposed between said moving contact plate and said coil block so that a bent portion at a distal end thereof is positioned above a push-in position of said moving contact plate, and said card acceptance portion of said moving contact plate has an escape portion for allowing insertion of said fixed contact plate.

* * * * *